US008979548B2

(12) United States Patent
Guttler

(10) Patent No.: US 8,979,548 B2
(45) Date of Patent: Mar. 17, 2015

(54) TRAINING DEVICE FOR BALL PLAYERS AND METHOD FOR THE TRAINING OF DIFFERENT SEQUENCES OF MOVEMENT

(76) Inventor: Christian Guttler, Berlin (DE)

( * ) Notice: Subject to any disclaimer, the term of this patent is extended or adjusted under 35 U.S.C. 154(b) by 635 days.

(21) Appl. No.: 12/667,639

(22) PCT Filed: Jun. 26, 2008

(86) PCT No.: PCT/EP2008/005235
§ 371 (c)(1),
(2), (4) Date: Jul. 26, 2010

(87) PCT Pub. No.: WO2009/003637
PCT Pub. Date: Jan. 8, 2009

(65) Prior Publication Data

US 2010/0285905 A1 Nov. 11, 2010

(30) Foreign Application Priority Data

Jul. 4, 2007 (EP) ..... 07013111

(51) Int. Cl.
*G09B 19/00* (2006.01)
*A63B 69/00* (2006.01)
*A63B 63/00* (2006.01)
*A63B 24/00* (2006.01)

(52) U.S. Cl.
CPC ..... *A63B 69/002* (2013.01); *A63B 69/0053* (2013.01); *A63B 63/00* (2013.01); *A63B 2024/0043* (2013.01); *A63B 2225/50* (2013.01); *A63B 2243/0025* (2013.01)
USPC ..... 434/247

(58) Field of Classification Search
USPC ..... 434/421, 422
See application file for complete search history.

(56) References Cited

U.S. PATENT DOCUMENTS

| | | | | |
|---|---|---|---|---|
| 4,627,620 | A | 12/1986 | Yang | |
| 6,709,351 | B2 * | 3/2004 | Hori | 473/455 |
| 2005/0272496 | A1 * | 12/2005 | Reinish et al. | 463/2 |

FOREIGN PATENT DOCUMENTS

| | | | |
|---|---|---|---|
| DE | 202006000799 | U1 | 5/2006 |
| DE | 102005042740 | A1 | 3/2007 |
| GB | 2380948 | A | 4/2003 |
| WO | 2005004999 | A | 1/2005 |
| WO | 2007039056 | A | 4/2007 |

OTHER PUBLICATIONS

International Search Report for PCT/EP08/005235 filed Jun. 26, 2008.
Corresponding U.S. Appl. No. 12/065,557, filed Mar. 3, 2008.

* cited by examiner

*Primary Examiner* — Sam Yao
*Assistant Examiner* — Evan Page
(74) *Attorney, Agent, or Firm* — Banner & Witcoff, Ltd.

(57) ABSTRACT

The problem of providing a training device and a training method with which it is possible to be able to train relatively complex game situations, in particular in handball and football, under consistent conditions and preferably in an actual playing environment is solved by the training device according to the invention, the training device comprising a plurality of ball receivers and ball providers, wherein the individual ball receivers and ball providers are designed as slave units in a local radio network in order to communicate with a master unit.

20 Claims, 10 Drawing Sheets

TRAINING DEVICE FOR BALL PLAYERS AND METHOD FOR THE TRAINING OF DIFFERENT SEQUENCES OF MOVEMENT

This application is a National Stage application of co-pending PCT application PCT/EP2008/005235 filed 26 Jun., 2008 which was published in US under PCT Article 21(2) on Jan. 8, 2009, which claims the benefit of the EP Application No. 07013111.5 filed 4, Jul. 2007 These applications are incorporated herein by reference in their entireties.

The invention relates to a training device for ball players and to a method for the training of different sequences of movement occurring during ball playing.

Such a training device is known from German Offenlegungsschrift DE 10 2005 042 740 A1.

In this known training device, a plurality of ball providers are used which may simultaneously also be ball receivers. By the arrangement of the ball providers and ball receivers in a space-consuming manner it is possible to improve the sportive capacity of coordination of the ball player since he/she receives the ball from an arbitrary ball provider and the ball receiver into which to play the ball is indicated by an acoustic or optical signal. By the high number of ball providers and ball receivers it is possible to train particular sequences of movement, in particular in handball or football, and to subsequently evaluate them. A focus of this known training device lies in the adjustability of the reaction and repetition rate of the individual training sequences, and in the different supply strength and supply rate. One advantage of this training device is to improve the capacity of reaction of the ball player in that the unique supplying of the ball to the player and the targeted shooting of the ball by the player may be trained under identical conditions for a long period.

It is a disadvantage of this training device that the ball player is not able to train relatively complex playing situations under identical conditions for a long period since exclusively unique ball contacts, i.e. a supplying of the ball to the player and a subsequent shooting of the ball by the player can be trained.

It is an object of the present invention to provide a training device and a training method with which it is possible to train relatively complex game situations, in particular in handball and in football, under consistent conditions and preferably in an actual playing environment.

This object is solved by a training device with the features of claim 1 and by a training method with the features of claim 11. The dependent claims 2 to 10 and 12 are directed to advantageous further developments of the present invention.

For the interaction of the ball with the ball receiver, the ball has to be taken at least in the vicinity of the ball receiver. However, whether the ball at least partially penetrates the ball receiver, is received by it, touches it, and/or bounces off it, etc. depends on the exact design of the training device or of the individual ball receivers, respectively.

In accordance with the invention, the training device comprises a plurality of ball receivers that are arranged in correspondence with the different embodiments of the invention either in a coherent frame structure with a plurality of other ball receivers, as a ball receiver cluster, or as individual ball receivers. A coherent frame structure may, for instance, be used in a hall as a stationary training device. Here, the ball receivers may have different sizes and may be smaller, in particular when training shots on goal, for instance, "penalty shots" on a wall consisting of ball receivers.

In another embodiment according to the invention, the ball receivers may be arranged as a ball receiver cluster consisting, for instance, of 3, 4, or 5 ball receivers arranged in series side by side. Likewise, the ball receiver clusters may be arranged on top of each other and simulate an artificial "wall" or a player to be supplied with the ball.

In a further embodiment according to the invention, the ball receivers may finally be used individually. In order to have a certain dimensional stability and robustness, all ball receivers are, in accordance with the invention, designed such that they comprise a frame in or at which sensors are arranged. Since the frame has to be designed such that it remains dimensionally stable also in the case of an unintentional contact with a ball, different technical measures have to be taken for this purpose.

In one embodiment according to the invention, the frame of the ball receivers may consist of a metal string material that is adapted to resist the impact of a ball and thus does not deform. Likewise, the frame of a ball receiver according to the invention may consist of an elastic string material that deforms temporarily when impacted with a ball and then returns to its original shape. Advantageously, carbon shanks such as they are, for instance, used for golf clubs may be used for the frame structure. Due to their dimensional stability and their resilient and light construction the carbon shanks are particularly suited for the frame structure of the ball receivers.

In accordance with the invention, sensors are provided in or at the frame structure which are adapted to detect the passage of a ball. Light barriers that are preferably pre-assembled on ledges may, for instance, be used as sensors.

The signal transmitter may, for instance, be a loudspeaker announcing the selected ball receiver, or a light beam pointing to the selected ball receiver. Likewise, it is possible that the ball receiver comprises a frame-shaped restriction characterized by a light band, for instance, by a light chain or light emitting diodes. This signal transmitter indicates into which ball receiver the user of the training device has to play the ball. In accordance with the invention, the signal may be set to an arbitrary duration and additionally convey to the user a particular message by means of colors or sound. It is, for instance, possible that the user is informed at very short notice of the current selected ball receiver, wherein the ball receiver may, however, also be indicated by a movable light or video signal. Such a training device in accordance with the invention is particularly suited to train the coordination of the user since the user only knows where to play the ball after the signal has been transmitted.

The ball receiver according to the invention further comprises a ball catching means that is, for instance, designed as a catching net and serves to decelerate the ball in the ball receiver and to convey it downwards.

Furthermore, the ball receiver according to the invention comprises an electronic slave unit into which the signal data of the ball receivers are read and transmitted to a master unit by means of radio. In addition to the sender unit, the electronic slave unit further comprises a receiver unit to receive signals from the master unit or from other slave units, respectively. The slave unit is, for instance, instructed by the master unit to output an acoustic or optical signal.

With the training device according to the invention it is possible to train in particular relatively complex game and standard situations such as they are known from football matches. An exemplary selection (to which the present invention is not restricted, though) of these game and standard situations that may be trained with the present invention is:

1. One-two with only one player
2. One-two with several players
3. Pass into the sprint of a player
4. Corner ball with chance for a header
5. Indirect free kick The training device according to the invention has the advantage that the user or the users first of all does/do not know from which ball provider a ball is supplied to the playing field, at which height they are supplied with the ball, and at which ball rate this will take place. Moreover, the user or the users does/do not know at what time the ball is to be passed to which ball receiver. By means of the sensor system that is disposed at the training device according to the invention and that is controlled, read out and evaluated by a master/slave system it is possible to train the game situations mentioned as examples above.

1. One-Two with Only One Player

In one embodiment of the present invention, the user is supplied with the ball by a ball provider. This may take place at different heights. After the leaving of the ball provider, for instance, a predetermined period Delta $t_1$ which may, pursuant to the respective training state, either be set manually or automatically, runs off in the timer of the main computer, i.e. the master unit. Delta $t_1$ determines the period between the ball delivery at $t_1$ and the signal output $t_2$ which indicates into which ball receiver the ball is to be conveyed. The value Delta $t_1$ may be chosen to be very short, for instance, only 0.1 s, or else longer, for instance, up to 5 s. Other time intervals are also possible. Depending on the training specification and the strength of the player the time interval may vary, and it may also be determined by a random function.

In order to perform a training in touch with reality, a first ball receiver into which the user has to play the ball is indicated to him or her after Delta $t_1$. This selected first ball receiver is, for instance, marked with a light border that flashes up for a short time only. The user thus has to try to play the ball into the selected first ball receiver during the short period. As soon as the ball has been detected by the sensor system in the selected first ball receiver, the user is given a second signal by another ball provider, for instance, the ball provider closest to the previously selected ball receiver, which indicates the second ball receiver into which the user has to play the ball. As soon as he or she has played the ball into the second ball receiver, the training move one-two with one player is finished and may start again.

2. One-Two with Several Players

In a further embodiment of the present invention the above-described training move one-two with one player is modified such that a first player or user is supplied with the ball by the training device at the time $t_1$ and has to accept it with the proviso that he or she passes this ball to a second player or user. This second player or user has to accept the ball and return it as quickly as possible to the first player or user. After the period Delta $t_1$ a ball receiver is indicated to the first player into which he or she has to play the ball. As soon as the first player or user has played the ball into the ball receiver, the training move one-two with several players is finished and may start again. This training move serves in particular the training of two players, wherein, however, further players or users may also participate therein. The period Delta $t_1$ has to be matched with the number of players or users when indicated.

3. Pass into the Sprint of a Player

In another embodiment of the present invention the user is supplied with a ball by a ball provider. This may take place at different heights. After the leaving of the ball provider, a predetermined period Delta $t_1$ which may, pursuant to the respective training state, either be set manually or automatically, runs off in the timer of the main computer. Delta $t_1$ determines the period between the ball delivery at $t_1$ and the signal output $t_2$ which indicates into which ball receiver the ball is to be conveyed. In contrast to the one-two moves the selected ball receiver, i.e. the area into which the ball has to be played, now is not static, i.e. stationary, but is subject to a particular change of place. The player or user thus faces the training situation in touch with reality that he or she is supplied with the ball and gets, after a period Delta $t_1$, a moving flare that moves at a particular rate. The player now has to play the ball, taking into account the time of flight of the ball, in the direction of the flare and "keep" it to such an extent that the ball coincides with the flare, i.e. the ball receiver selected then. If a coincidence occurs, the move was finished successfully.

4. Corner Ball with Chance for a Header

In a further embodiment of the present invention the user or player or the users or players is/are positioned in the training device according to the invention such that preferably the dimensions of a real field section with corner flag are represented. In the case of a corner ball this may be, depending on the dimensions of the field, a distance of approx. 25 m to 38 m between the center of the goal and the corner flag. A ball provider is, for instance, positioned at the position of the corner flag and supplies a ball in the direction of the user(s) or player(s). After a period Delta $t_1$ a ball receiver into which the ball is to be played is selected by means of signal output. Since a targeted playing or placing of the ball is more difficult by head than by foot, several ball receivers may also be selected in accordance with the invention. It is, for instance, possible to position and select ball receivers such that the usual goal dimensions of 2.44 m times 7.32 m can be simulated in touch with reality. In accordance with the invention it is therefore possible to "interconnect" a plurality of ball receivers so as to select particular regions of a goal, for instance, sectors or quadrants. The respective size of the regions is determined by the size of the ball receivers. An "interconnection" may, for instance, be performed via the system control of the master unit.

A particular advantage of this embodiment according to the invention is the possibility of repeating the standard situation corner ball under repeatable conditions as often as desired, wherein in particular the covering of the goal, i.e. the ball receiver, may also be trained in touch with reality.

By the possibility of supplying a ball at different heights it is, with the training unit "corner ball", possible in a further embodiment of the present invention to supply the ball "flat" or "high" to a user or player. This realistic surprise effect enables to play the ball into one or several selected ball receivers via an "intermediate station". With respect to the moves used this embodiment resembles the embodiment "indirect free kick" explained in the following.

5. Indirect Free Kick

In a further embodiment of the present invention the ball is supplied by a ball provider either "flat" or "high" to a user or player. After the predetermined period Delta $t_1$ a ball receiver is selected into which the respectively last user or player has to play the ball.

In all the afore-mentioned game and standard situations all ball movement data are collected and stored by the sensor system, the central or master unit of the training device according to the invention, and transmitted to an evaluation software where indicated.

In a preferred embodiment of the present invention the training device defines a field, or the training device comprises a field, respectively, on which the user stays during the training with the training device.

In another preferred embodiment of the present invention the training device is built up only at one side of a field, for instance, a football field. This embodiment is, for instance, suited particularly well for the move "pass into the sprint of a player".

In another preferred embodiment of the present invention the training device is built up at two or three sides of a field, for instance, a football field.

In another preferred embodiment of the present invention the training device is built up in an arbitrary manner on the field, for instance, a football field. In this embodiment the ball receivers may be arranged arbitrarily, individually or as a cluster, on the field. Exactly the modular construction of this preferred embodiment offers the advantage to also train very complex moves under realistic conditions.

In all the afore-mentioned embodiments the ball receivers and the ball providers may be arranged separately from each other. It may nevertheless be of advantage that a ball provider is simultaneously also a ball receiver since the opening of the ball provider may also be equipped with sensors to serve as a ball receiver.

An essential advantage of the modular embodiment of the present invention consists in that the arrangement of the ball receivers and ball providers on a field may be performed arbitrarily since all modules are in radio contact with each other and are thus adapted to exchange all the data with one another.

In a preferred embodiment of the present invention every ball receiver has its own identification, i.e. address. By means of this address it is possible for the master unit to address every ball receiver and provide it, for instance, with particular instructions. A possible instruction to the ball receiver 001 would be to output in Delta $t_1$ a light signal for the duration of Delta $t_2$. Another possible instruction to the ball receiver 001 would be to output in Delta $t_1$ a light signal for the duration Delta $t_2$ and to the ball receiver 002 after Delta $t_1+t_2$ a signal for the duration Delta $t_2$, etc. Due to the wireless radio networking of the master unit with the slave units of the ball receivers it is possible to trigger every ball receiver at a desired time and to transmit corresponding signals. By means of the sender units in the ball receivers it is possible to transmit the respective sensor data to the master unit.

If, for instance, a ball receiver is selected by a random generator or due to a particular training plan and instructed via radio by the master unit to output a signal that indicates that this ball receiver is ready to accept the ball, all the other ball receivers are also instructed to activate their sensors. Likewise it is possible that all the sensors are always activated. If the ball is then not played into the selected ball receiver by the user or player, but into a different ball receiver, this result is transmitted to the master unit and is stored. For the evaluation of the training data it is therefore essential that as many data as possible are transmitted to the master unit. A possible selection of these data is:

1. Time of ball delivery $t_0$;
2. duration until the signal output of the selected ball receiver $t_1$;
3. address and location of the selected ball receiver;
4. duration until the signal generation by an arbitrary ball receiver;
5. address and location of the ball receiver that accepted the ball.

From these transmitted data it is possible for an evaluation software to reliably determine the accuracy in shots on goal and the playing rate. Via a graphical interface it is possible to represent the performance of the user or player and to compare it with older data when indicated so as to be able to ascertain training success.

In accordance with the invention the data of various users may be stored and compared with each other. It is also possible to observe the data of one single user for a longer period and to record possible improvements or deteriorations of his training state.

The present invention will be explained in detail by means of the following Figures that relate to different embodiments. There show:

FIG. 1 a schematic representation of an individual ball receiver according to the invention in accordance with an embodiment of the present invention;

FIG. 2 a schematic representation of the mode of operation of the slave unit;

FIG. 3 a systematic representation of the master unit in accordance with a preferred embodiment of the present invention;

FIG. 4 a ball receiver according to the invention of another preferred embodiment of the present invention;

FIG. 5 a possible arrangement of ball receivers according to the invention;

FIG. 6 a further arrangement possibility of ball receivers according to the invention;

FIG. 7 a possible arrangement of the training device according to the invention for the training method according to the invention;

FIG. 8 another possible arrangement of the training device according to the invention, for instance, for the training method according to the invention: move one-two;

FIG. 9 another possible arrangement of the training device according to the invention, for instance, for the training method according to the invention: move corner ball with chance for a header;

FIG. 10 another possible arrangement of the training device according to the invention, for instance, for the training method according to the invention: move pass into the sprint;

FIG. 11 another possible arrangement of the training device according to the invention, for instance, for the training method according to the invention: move one-two with several players;

FIG. 12 another possible arrangement of the training device according to the invention, for instance, for the training method according to the invention: move one-two with several players variant 2;

FIG. 13 another possible arrangement of the training device according to the invention, for instance, for the training method according to the invention: move indirect free kick.

FIG. 1 shows a preferred embodiment of a ball receiver 100 according to the invention which is expediently designed of a frame construction 101, wherein the individual elements of the frame construction are expediently strongly connected with each other so as to have a certain resistance against impacting balls. The corner regions of the ball receiver 100 according to the invention are expediently designed such that a safe stacking of the ball receivers 100 according to the invention is possible, wherein non-positive and/or positive connecting elements serve to arrange a plurality of the ball receivers 100 according to the invention in such a dimensionally stable manner that, for instance, a wall (see FIG. 5) or a lengthy arrangement (see FIG. 6) is possible. At the front side of the ball receiver 100 according to the invention a frame 103 is arranged which comprises at its inner side a plurality of sensors, for instance, light barriers 105 *a-k* which are arranged and designed such that a ball flying through the frame 103 can reliably be detected by these sensors. Downstream of the frame 103 a ball catching means 102 is positioned which is arranged and designed such that a ball flying through the frame 103 is reliably decelerated and conveyed downwards by the ball catching means 102, for instance, a catching net.

Furthermore, every ball receiver 100 according to the invention comprises a slave unit 104 in which a computer unit is arranged which is operatively connected with the sensors and the signal output device (not illustrated). Furthermore, this computer unit comprises a sender and receiver unit for communication with the master unit and/or other ball receivers.

As is further illustrated in FIG. 1, every ball receiver 100 according to the invention comprises an address (e.g. #001) that serves to unambiguously identify every ball receiver 100 according to the invention or to unambiguously assign signals sent out by the slave unit 104 to a ball receiver according to the invention.

FIG. 2 shows a schematic representation of the slave unit 104 and the operative connection thereof with the frame 103. The slave unit 104 controls the signal output device 106 that is, for instance, designed as a light band, light emitting diodes, or the like, i.e. the point in time of the signal output and the signal duration are controlled via the slave unit 104. Furthermore, the slave unit 104 processes the signals received from the sensors 105 *a-k*.

In accordance with the invention, the slave unit is adapted to send the signals received from the sensors 105 *a-k* either directly to a master unit 300 via the air interface or to perform a pre-processing of these signals and to subsequently send a pre-processed signal to the master unit 300. Both options are provided for in the training device according to the invention. It is, however, also possible to only provide one of these options in the training device according to the invention if this is desired by the user or if this is useful due to the type of use.

FIG. 3 shows a schematic representation of the master unit 300 that is operatively connected with a display device, for instance, a monitor 301. On this monitor 301 it is, for instance, possible to indicate to a user, for instance, the training supervisor, the advance setting of the moves, the levels of difficulty, the personal data, the move data, or any other data which are either entered manually or generated by the training device according to the invention. The further processing of all or some data, for instance, by their feeding into data bases, the Internet, LANs, WLANs, or the connection to a printer are indeed only illustrated schematically, but are nevertheless part of the present invention.

FIG. 4 shows a further embodiment of a ball receiver 100 according to the invention, wherein a display device 107 is positioned in the rear area of the ball receiver according to the invention which serves to represent an image signal, for instance, a play sequence or a play outline. This particular embodiment of the present invention has, in particular with the move "pass into the sprint of a player" (see FIG. 10), the advantage that a simulation close to reality can be performed to which ball receiver 100 the ball is to be played in that the signal is indicated to the user on the display device 107 as a video sequence, for instance, as a running person.

Figure 7:
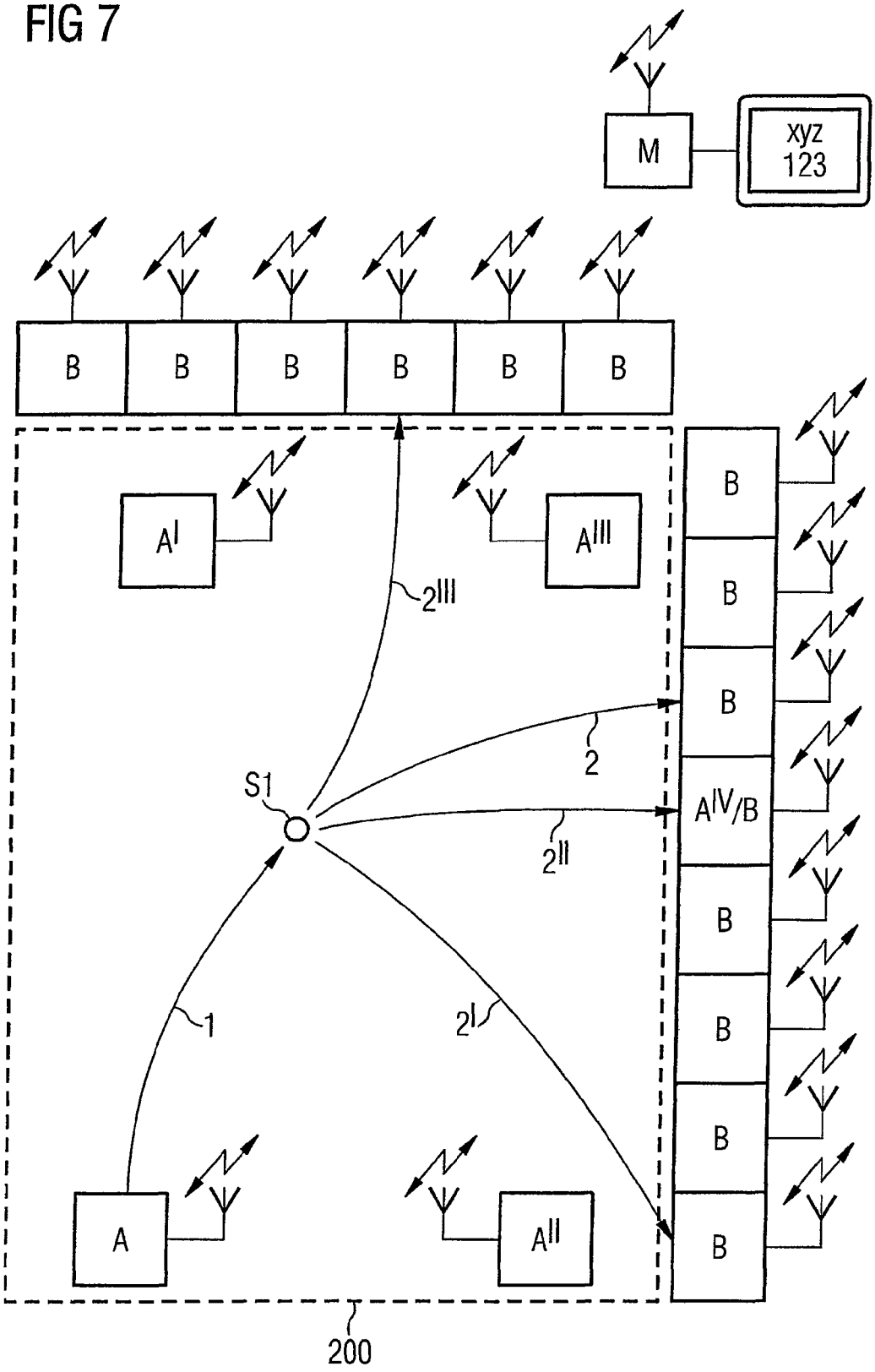

FIG. 7 shows a conceptual arrangement of the training device according to the invention with a plurality of ball receivers B and ball providers A-$A^{IV}$. The ball providers determine a field 200 that is illustrated with a dashed border. All ball providers A-$A^{IV}$ and ball receivers B are connected via the air interface with the master unit M and are triggered by it.

All signal data generated by the ball receivers are sent to the master unit. FIG. 7 shows an exemplary move in which a player S1 is supplied by the ball provider A with a first pass (#1) with a ball. In accordance with a signal output by the master unit M a ball receiver B is selected with the instruction of generating, after a particular time Delta $t_1$, a signal indicating to the player S1 into which ball receiver to convey the ball.

As examples, the further moves 2 to $\mathbf{2}^{III}$ are shown in FIG. 7 which each constitute different moves. The master unit M instructs the ball providers A-$A^{IV}$ at which ball rate, at which height, and after which time interval the player S1 is again supplied with a ball. These parameters serve the determination of the different levels of difficulty and may be determined in any manner by an adviser or trainer of the master unit.

Figure 8:
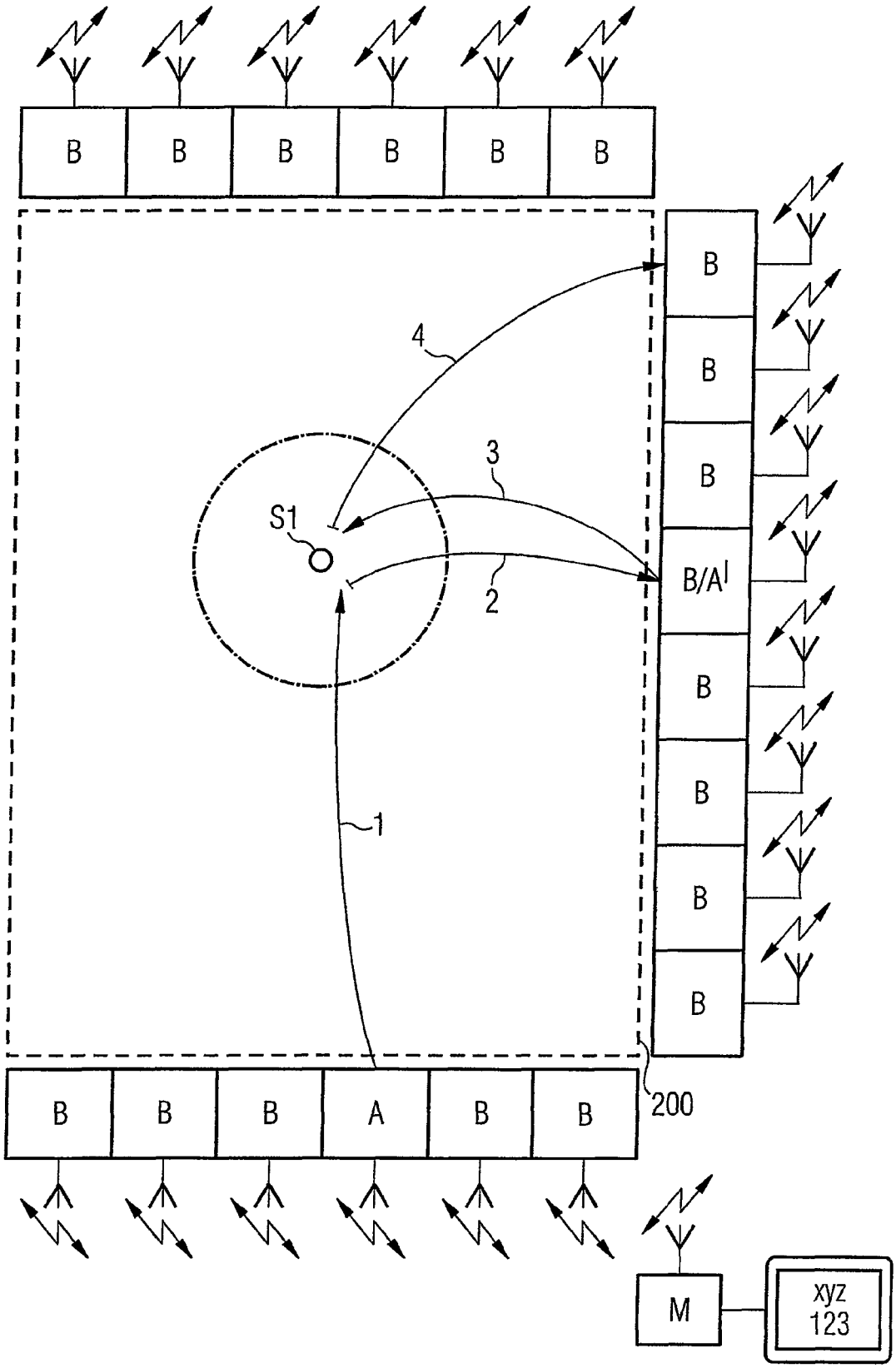

FIG. 8 shows a further arrangement of the training device according to the invention, wherein the field 200 is limited at three sides by ball receivers B and ball providers A, A'. For training and simulating a two-one move, the ball provider A supplies, for instance, in a first pass (#1) a ball to the player S1 which he or she has to supply to the ball provider B in a second pass (#2) so as to then be again supplied with a ball by the ball provider A' in rapid succession which the player S1 has to supply to a ball provider in a fourth pass (#4). This move is also controlled and monitored via the master unit M.

Figure 9:
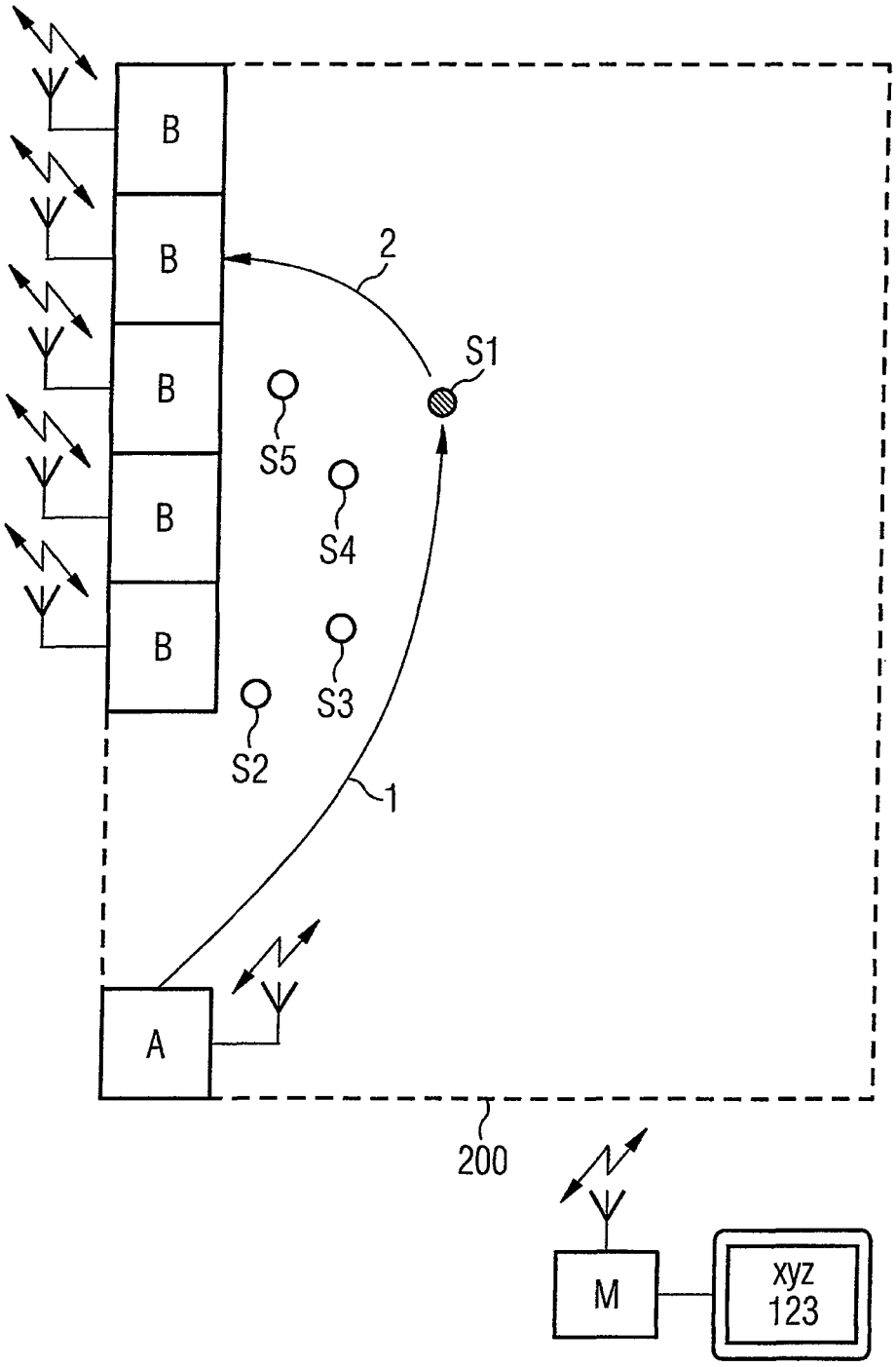

FIG. 9 shows the move of a corner ball with chance for a header in which the ball provider is arranged in a corner of the field 200 and the ball receivers B are arranged such that they assume the dimension of a football goal with respect to the dimensions and the distance to the ball provider A. On a signal of the master unit M the ball provider A supplies a ball in a first pass (#1) preferably as a high ball to the player S1 which he or she has to convey by means of a header (#2) in the direction of the ball providers. For better simulation players S2, S3, S4, and S5 may also be positioned on the field 200 to simulate the situation of ball protection and goal protection close to reality.

Figure 10:
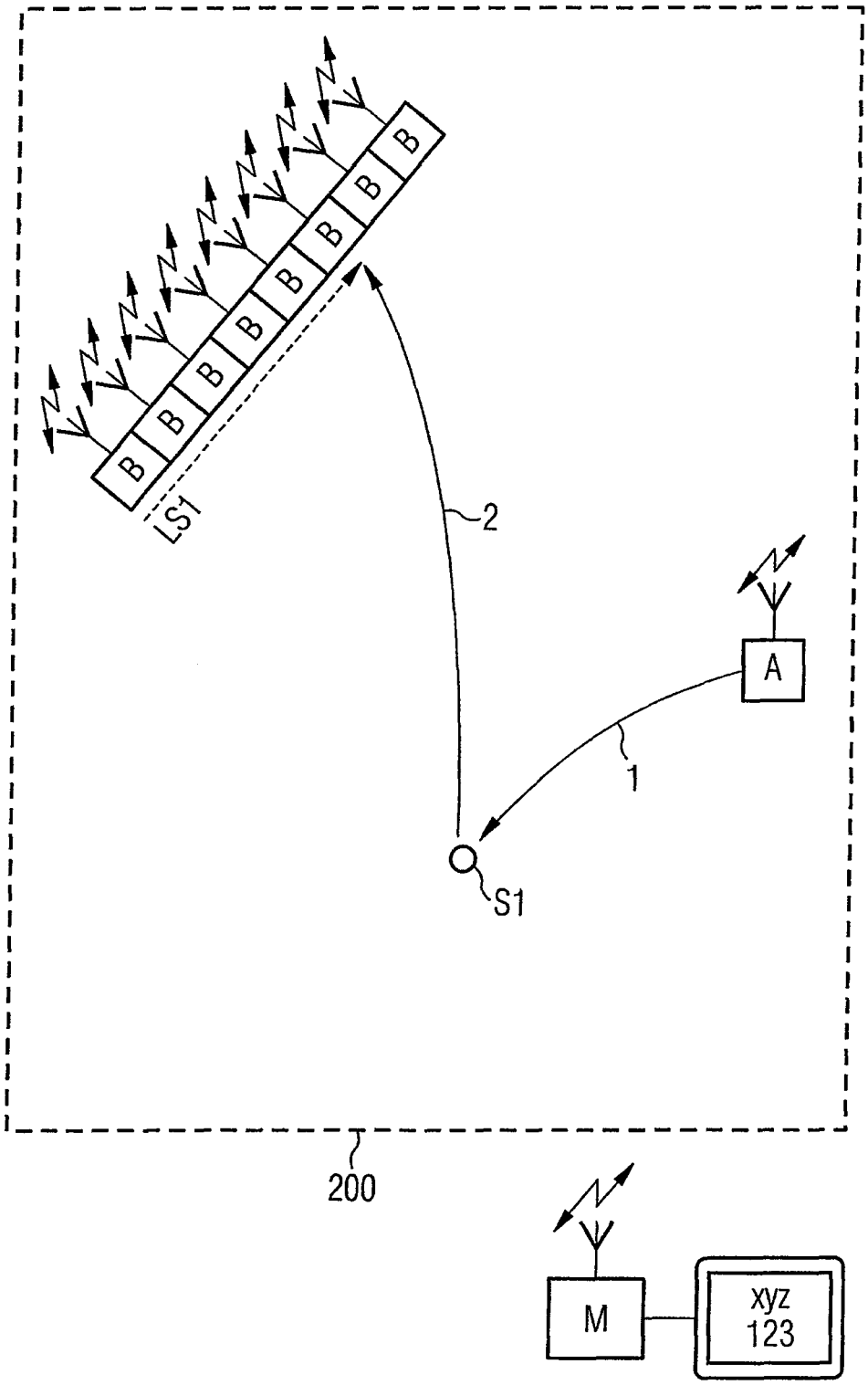

FIG. 10 shows a further embodiment of the present invention in which a plurality of ball receivers B are arranged in series, for instance, also on top of each other such that they form a wall. At the beginning of the move "pass into the sprint of a player" the ball provider A supplies a ball to the player S1 (#1) which he or she has to play into a ball receiver B, wherein the signal indicating the selected ball receiver migrates dynamically along the arrow LS1, wherein the rate may be adapted in a realistic manner to the running speed of a player. The player S1 thus has the object of anticipating the speed and the place of the simulated player so as to "hit" with his or her pass (#2) the ball receiver that is "selected", i.e. emphasized by the signal output device at that time.

Figure 1:
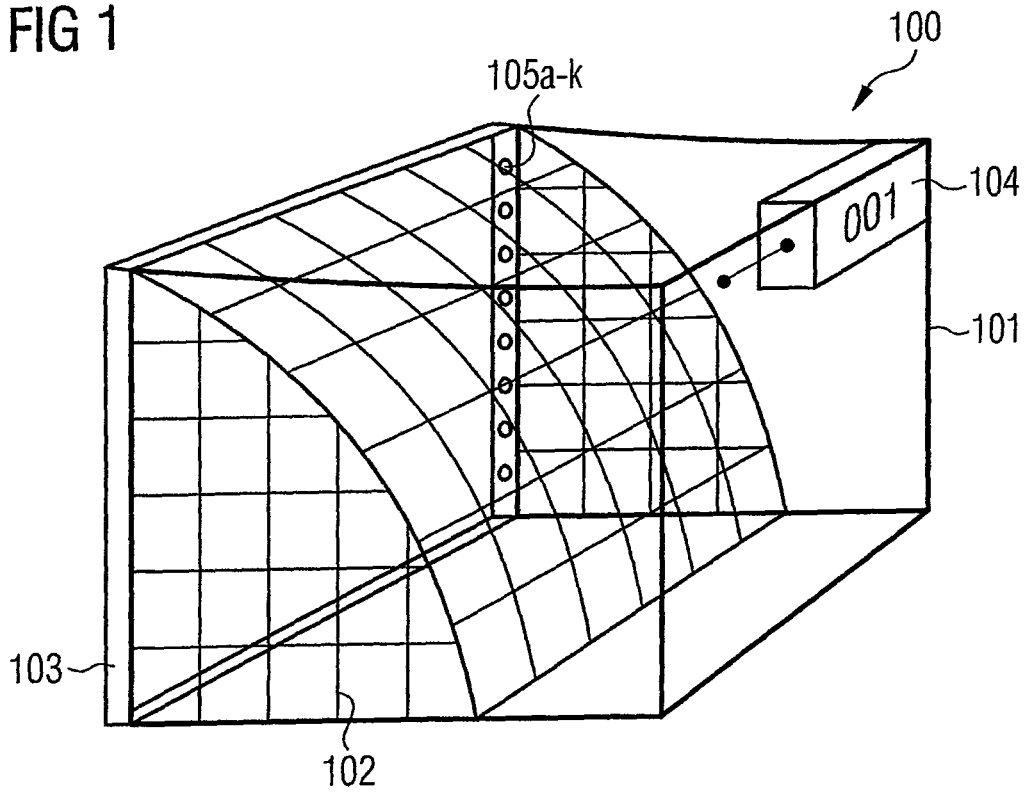
Figure 2:
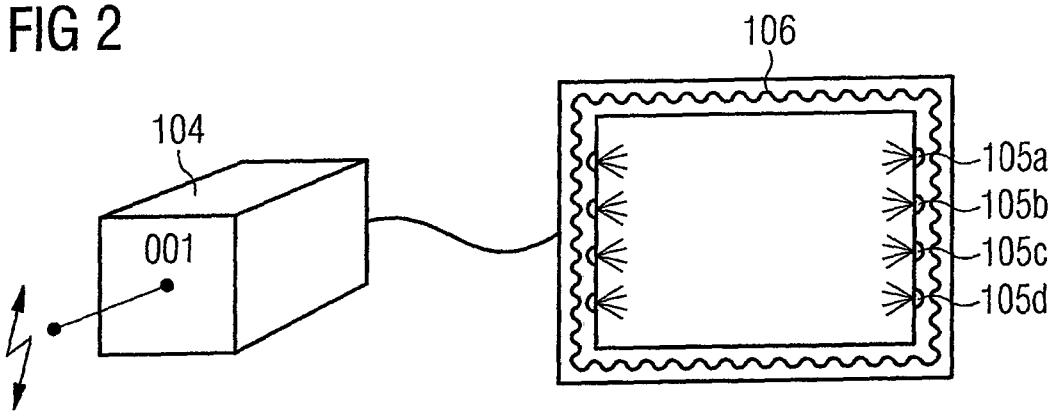
Figure 3:
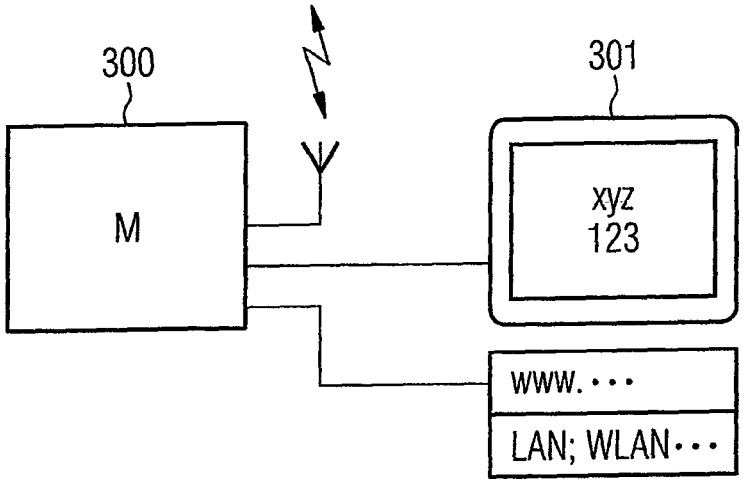
Figure 4:
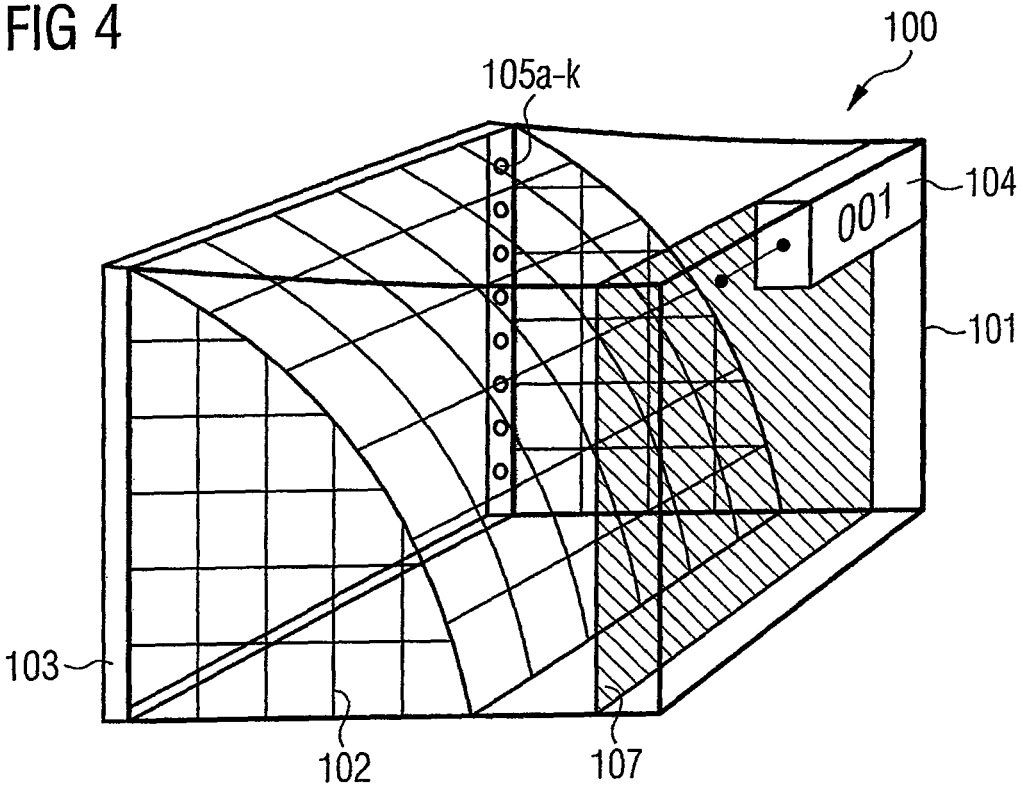
Figure 5:
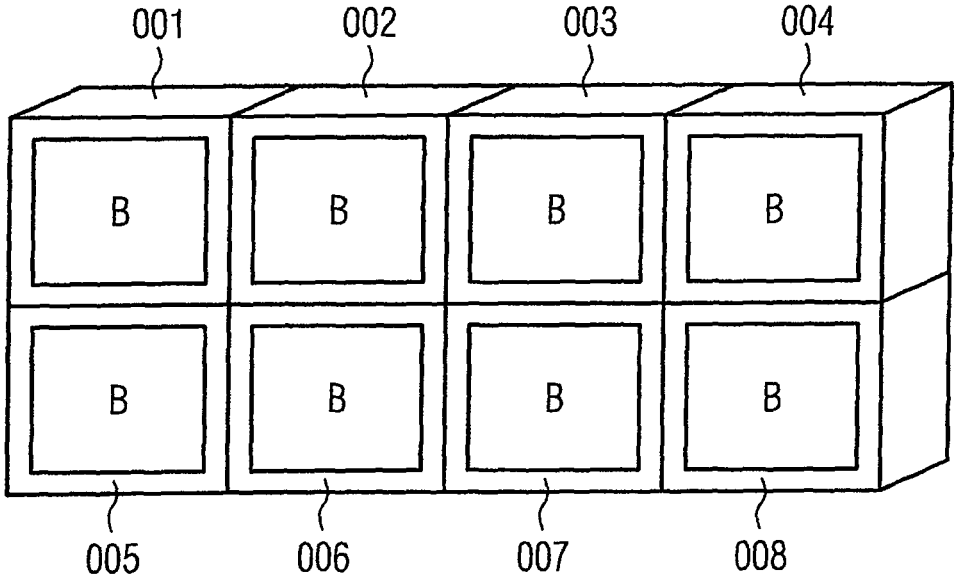
FIG. 5 shows a further possible arrangement variant of the ball receivers according to the invention. If, as illustrated in FIG. 5, a plurality of ball receivers according to the invention are arranged on top of each other and side by side, it is possible to form a closed wall with ball receivers into which a ball is to be conveyed.
Figure 6:
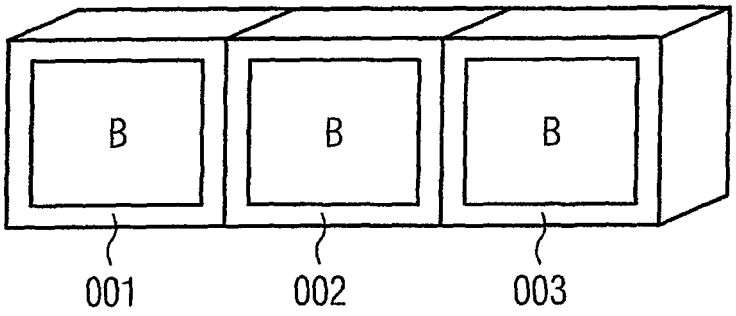
FIG. 6 shows a modification of the arrangement possibility of FIG. 5, with the difference that ball receivers are merely arranged side by side, but no ball receivers are arranged on top of each other.

In a preferred embodiment of the present invention this simulation may be implemented by a flat screen or by a series of flat screens, respectively, which is or which are, pursuant to FIG. 4, arranged in the ball receivers 100 according to the invention. From the perspective of the player S1 the flat screens 106 form a substantially closed wall on which a video signal may be played which shows, for instance, a running player who is prepared for the pass #2. The difficulty of this move may be varied both via the speed of the changing signal, via the arrangement of the ball receivers B, the distance between S1 and the ball receivers, and via the intensity of the supply in the first pass (#1). Thus, it is for instance possible according to the invention that the player S1 is supplied by the ball provider A with a high ball which he or she has to stop with his or her "breast", and that, due to the quickly moving light signal LS1, only few split seconds of time remain for conveying the ball in the direction of the signal output device and thus into the predetermined ball receiver, for instance, with a volley shot.

Figure 11:
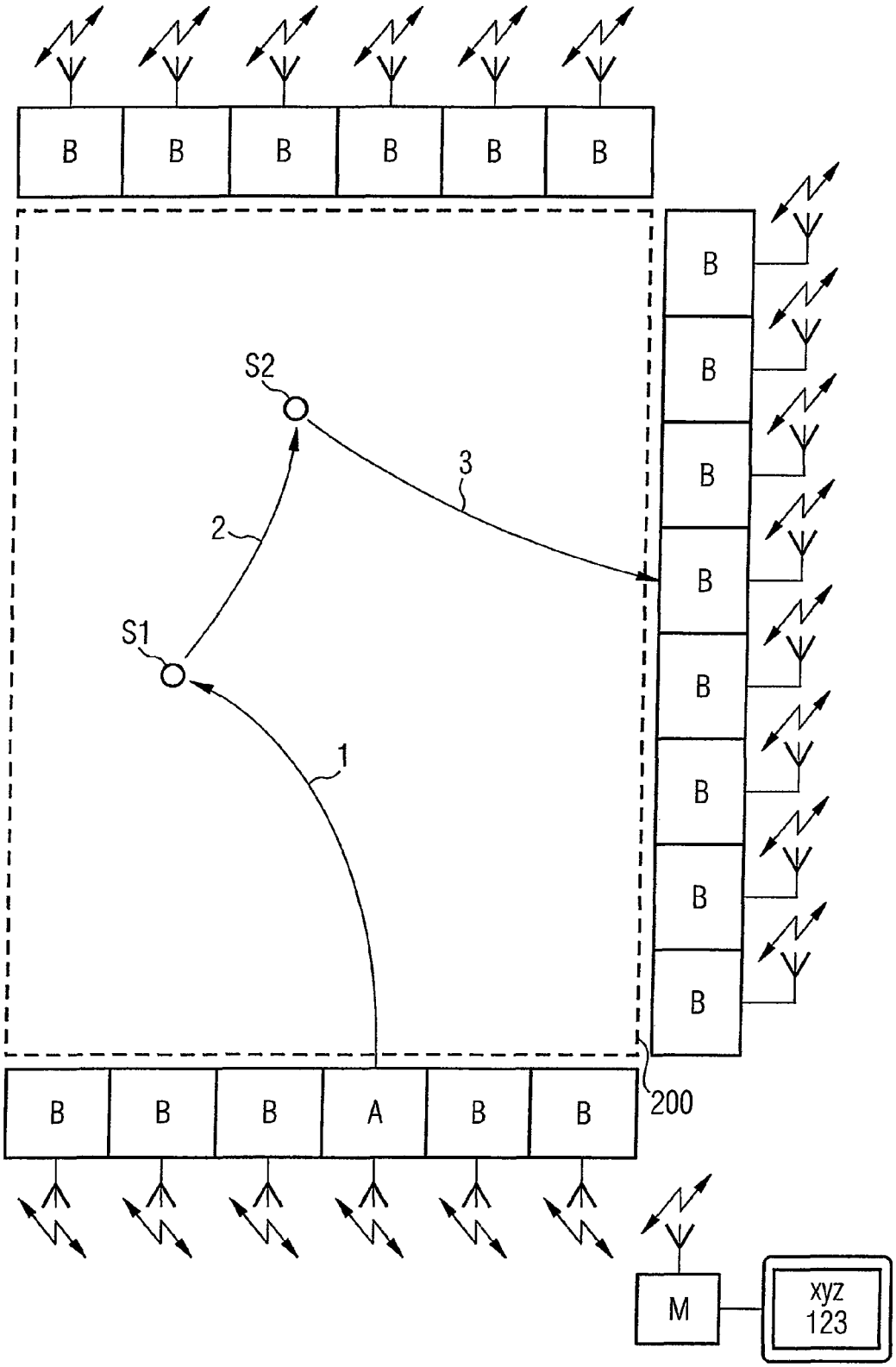

FIG. 11 shows a further embodiment according to the invention in which two players S1 and S2 are positioned on the field 200. The ball provider supplies the player S1 with a first move and he or she has to supply the player 2 with the pass #2 as quickly as possible. S2 receives a signal to convey the ball into a predetermined ball receiver B with the pass #3.

Figure 12:
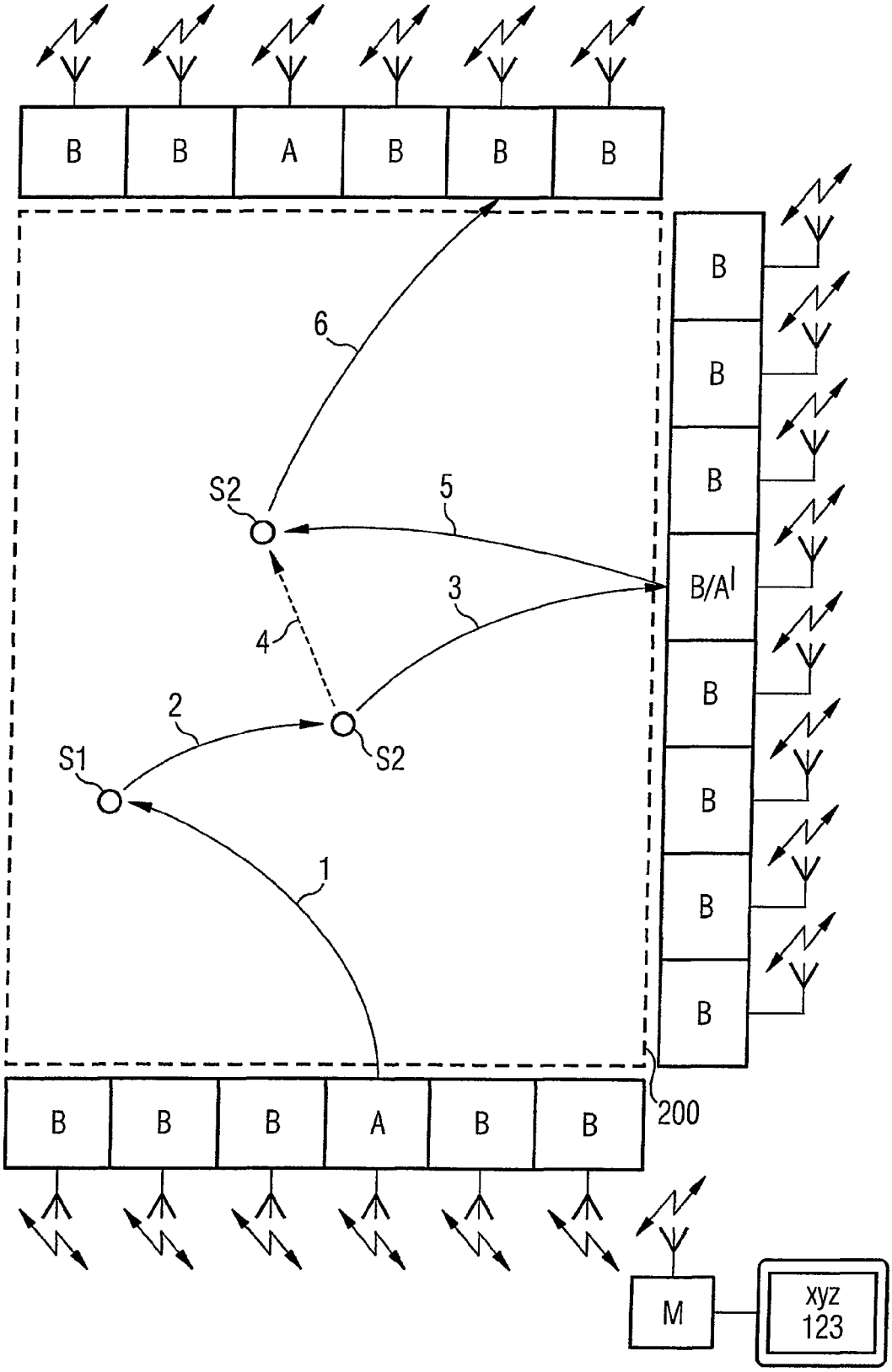
Figure 13:
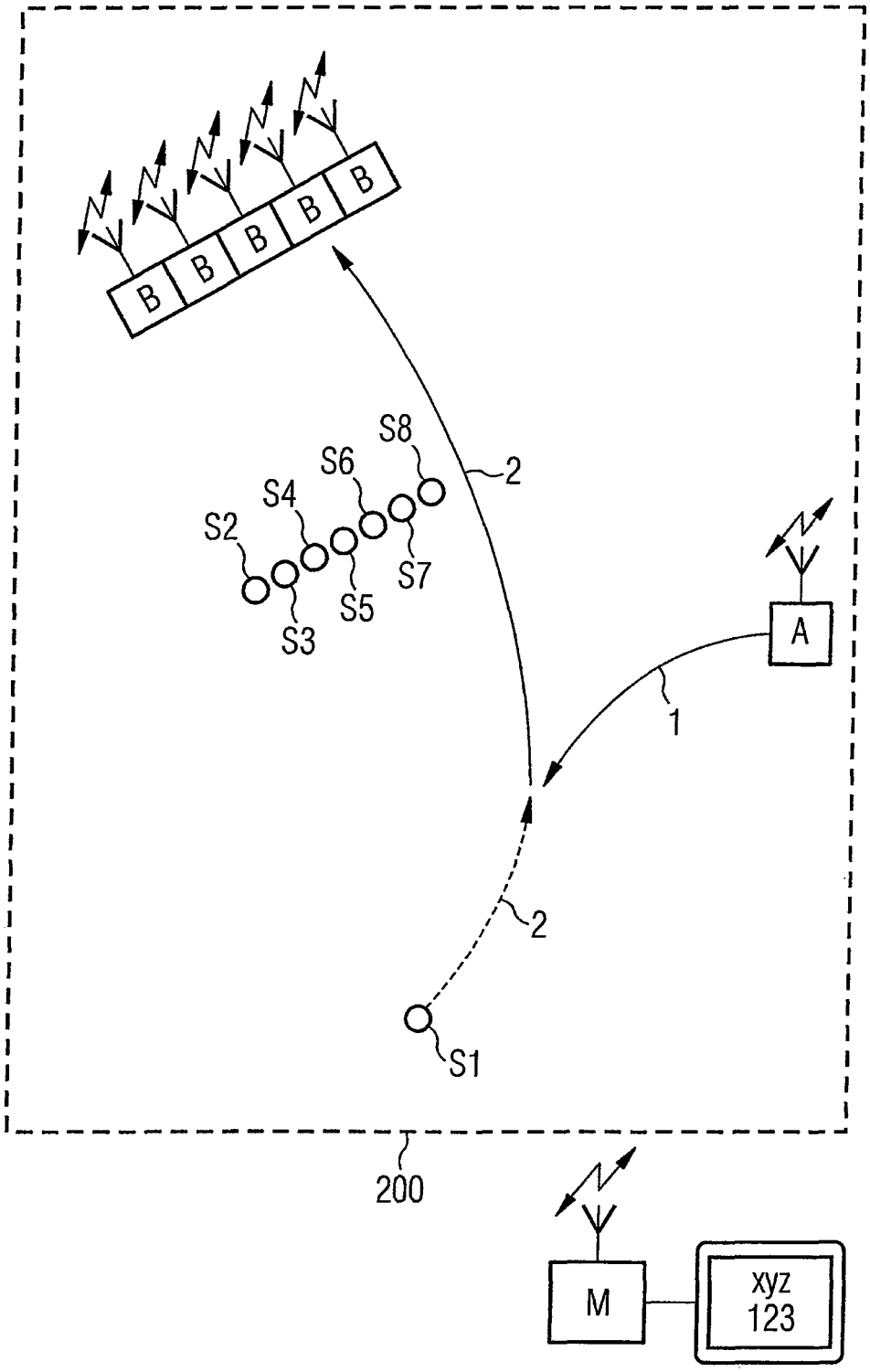

FIG. 12 shows a further embodiment of the device according to the invention in which also two players S1 and S2 are on the field 200. The ball provider A supplies the ball in a first pass (#1) to S1 who plays a pass (#2) to the player S2 which he or she supplies in a third pass (#3) to a ball receiver and prepares for the acceptance of a ball (#5) delivered by the ball provider A' by covering the distance (#4). After the player S2 has received the pass (#5) he gets the signal to play the ball into a ball receiver B by means of pass (#6).

In a further embodiment of the present invention the move indirect free kick is trained in that the ball provider A plays the ball in a first pass (#1) in the direction S1. The player S1 runs into the first pass (#1) and plays the ball around a "wall of the players S2 to S8" to a predetermined ball receiver B selected by the master unit M.

In a further embodiment of the present invention no sensors are applied at the ball receivers, but the locating of the ball is performed via a sender in the ball. To this end, a particular number of receivers are placed at and around the training device according to the invention which receive the signal of the ball and are capable of performing the exact localization of the ball by means of the signal direction and strength. In this embodiment of the present invention it is only required that a signal is output for the respective ball receivers, but light barriers for determining whether a ball was conveyed through a particular ball receiver are no longer necessary.

The invention claimed is:

1. A training device comprising:

a plurality of ball receivers configured to receive a ball;

at least one first ball provider configured to provide the ball and to receive the ball; and at least one second ball provider configured to provide the ball, wherein the individual ball receivers, the at least one first ball provider, and the at least one second ball provider are designed to communicate with a central unit, wherein the at least one first ball provider includes an opening with sensors configured to supply the ball and to receive the ball, wherein the at least one second ball provider is configured to provide the ball upon a first instruction received from the central unit, wherein the at least one first ball provider further includes a light border configured to flash light during a time period, upon a second instruction from the central unit, to indicate to a user which of the at least one first ball provider, the at least second ball provider, or a ball receiver of the plurality of ball receivers, is designated to accept the ball, wherein upon receipt of the ball during the time period, the at least one first ball provider is configured to provide the ball upon a third instruction from the central unit.

2. The training device according to claim 1, wherein an unambiguous address is assigned to every ball receiver, and the at least one first ball provider, and the at least one second ball provider, which serves an identification of the ball receiver, the at least one first ball provider, and the at least one second ball provider during a communication with each other and with the central unit.

3. The training device according to claim 2, wherein every ball receiver and ball provider comprises a computer unit with sender/receiver devices.

4. The training device according to claim 1, wherein each ball receiver comprises a frame-shaped opening with sensors.

5. The training device according to claim 4, wherein the sensors of the ball receivers and the at least one first provider are light barriers and perceive passage of a ball.

6. A training device comprising:

a substantially dimensionally stable frame structure comprising an opening, wherein a ball catching device is located downstream of the opening;

sensors that are arranged at the dimensionally stable frame structure;

a signal output device that is arranged at the dimensionally stable frame structure;

a computer unit that is operatively connected both with the sensors and with the signal output device;

a sender/receiver unit configured for communication with a central unit and/or other ball receivers; and a plurality of ball providers configured to provide a ball through openings after a time interval upon receipt of an instruction from the central unit, wherein upon designation, the ball receiver is configured to receive a ball, supplied by any ball provider, during play.

7. The training device according to claim 6, wherein fastening means are provided which serve to connect a plurality of ball receivers with each other.

8. The training device according to claim 6, wherein a flat screen is arranged in the frame structure which is operatively connected with the computer unit.

9. The training device according to claim 6, wherein the signal output device is a flat screen that is arranged such that it is protected by the ball catching device.

10. A training device comprising:

a plurality of ball receivers configured to receive a ball;

at least one first ball provider configured to provide the ball and to receive the ball; and at least one second ball provider configured to provide the ball, wherein the individual ball receivers, the at least one first ball provider, and the at least second ball provider form a local radio network to communicate with a central unit, wherein the central unit performs localization of the ball with respect to every ball receiver, the at least one first ball provider and the at least second ball provider via a plurality of receivers, wherein the at least one first ball provider and the at least second ball provider are configured to provide the ball at a ball rate, at a height, and after a time interval based upon an instruction from the central unit.

11. The training device according to claim 1, wherein each ball receiver includes a display device.

12. The training device according to claim 11, wherein each ball receiver includes a computer unit configured to receive additional instructions from the central unit.

13. The training device of claim 12, wherein the additional instructions include a time period for rendering an output to the display device of the ball receiver.

14. The training device of claim 1, wherein each of the plurality of ball receivers and the at least one second ball provider further includes:

a light border, and a computer unit configured to receive a fourth instruction from the central unit, wherein the fourth instruction includes a time period for flashing up the light border of the ball receiver or the at least one second ball provider.

15. The training device of claim 1, wherein the individual ball receivers, the at least one first ball provider, and the at least one second ball provider are communicate with the central unit in a radio network.

16. The training device of claim 1, wherein the at least one first ball provider and the at least one second ball provider are configured to provide a ball at various heights.

17. The training device of claim 1, wherein the ball receivers each includes a signal transmitter, configured to indicate to the user, by emitting an optical and/or acoustic signal, one of the ball receivers into which to play the ball.

18. The training device of claim 1, wherein a random generator for selecting which one of the ball receivers is designated to accept the ball supplied by c the at least one first ball provider or the at least one second ball provider.

19. A training method comprising:

1. selecting a training move;
2. positioning at least one player on a field having a plurality of ball receivers, a plurality of ball providers, a central unit in communication with the ball receivers and ball providers, wherein at least one ball receiver is configured to provide balls to the at least one player and receive balls supplied by any ball provider during play;
3. starting the training move;
4. selecting a ball provider, by the central unit, to first supply a ball during play, wherein the selection of the ball provider is unknown to the user;
5. activating all sensors of the ball receivers;
6. designating a first ball receiver configured to receive a ball and provide a ball, into which the first ball supplied must be played;
7. outputting a signal at the first designated ball receiver;
8. supplying, by the first designated ball receiver, the ball for a second time during play in a direction, at a height and at a rate as communicated by the central unit;
9. designating a second ball receiver, into which the ball supplied must be played;
10. outputting a signal at the second designated ball receiver;
11. detecting the ball in a ball receiver of the plurality; and
12. repeating steps 3-11.

20. The training method according to claim 19, wherein steps 3 to 11 are executed based on step 1.

* * * * *